US011403948B2

(12) United States Patent
Tseng

(10) Patent No.: US 11,403,948 B2
(45) Date of Patent: Aug. 2, 2022

(54) WARNING DEVICE OF VEHICLE AND WARNING METHOD THEREOF

(71) Applicant: Po-Kai Tseng, Taipei (TW)

(72) Inventor: Po-Kai Tseng, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 17/177,228

(22) Filed: Feb. 17, 2021

(65) Prior Publication Data

US 2021/0264786 A1 Aug. 26, 2021

Related U.S. Application Data

(60) Provisional application No. 62/982,027, filed on Feb. 26, 2020.

(51) Int. Cl.
*G08G 1/16* (2006.01)
*G08G 1/052* (2006.01)

(52) U.S. Cl.
CPC ..... *G08G 1/16* (2013.01); *G08G 1/052* (2013.01)

(58) Field of Classification Search
CPC ..... G08G 1/16; G08G 1/052
See application file for complete search history.

(56) References Cited

U.S. PATENT DOCUMENTS

| | | | | |
|---|---|---|---|---|
| 8,660,734 | B2 | 2/2014 | Zhu et al. | |
| 2011/0187518 | A1* | 8/2011 | Strumolo | B62D 15/029 340/438 |
| 2016/0023598 | A1* | 1/2016 | Kohler | G01S 13/931 340/435 |
| 2016/0347310 | A1* | 12/2016 | Moran | G08G 1/16 |
| 2019/0096256 | A1* | 3/2019 | Rowell | G01S 17/58 |
| 2019/0205609 | A1 | 7/2019 | Taveira et al. | |

FOREIGN PATENT DOCUMENTS

| | | | |
|---|---|---|---|
| CN | 110001633 | | 7/2019 |
| TW | I531499 | | 5/2016 |
| TW | I531499 B | * | 5/2016 |
| TW | 202024829 | | 7/2020 |

OTHER PUBLICATIONS

"Office Action of Taiwan Counterpart Application", dated Jun. 16, 2021, p. 1-p. 7.

* cited by examiner

*Primary Examiner* — Mohamed Barakat
(74) *Attorney, Agent, or Firm* — JCIPRNET

(57) ABSTRACT

A warning device of a vehicle and a warning method thereof are provided. Determine an attribute and behavior of a target object based on sensing data of a sensor. Provide a first warning signal according to the attribute and the behavior of the target object. Provide a second warning signal based on dynamic information of the vehicle, the attributes and the behavior of the target object.

12 Claims, 2 Drawing Sheets

WARNING DEVICE OF VEHICLE AND WARNING METHOD THEREOF

CROSS-REFERENCE TO RELATED APPLICATION

This application claims the priority benefit of U.S. provisional application Ser. No. 62/982,027, filed on Feb. 26, 2020. The entirety of the above-mentioned patent application is hereby incorporated by reference herein and made a part of this specification.

BACKGROUND

Technical Field

The disclosure relates to an electronic device, and more particularly to a warning device of a vehicle and a warning method thereof.

Description of Related Art

Advanced driver assistance system (ADAS) refers to various sensors installed on a vehicle, which are configured to sense parameters such as light, heat source, and pressure by collecting data inside and outside the vehicle to notify the driver to pay attention to what is happening right away.

However, the driver needs to have considerable experience in predicting the distance required for braking, and it is also difficult to determine whether the vehicle may be operated in line with expectations. In addition, the concentration of the driver may inevitably be reduced, which causes the time taken by the driver to respond to the surrounding vehicles, pedestrians, etc. to be delayed. For more serious cases, the driver may even neglect and miss the chance to decelerate in advance to prevent collisions, resulting in accidents.

SUMMARY

The disclosure provides a warning device of a vehicle and a warning method thereof, which can predict and prevent accidents, thereby improving driving safety.

A warning device of a vehicle of the disclosure includes a warning signal generator, a sensor, and a processor. The sensor senses a target object to generate sensing data. The processor is coupled to the warning signal generator and the sensor to determine an attribute and a behavior of the target object according to the sensing data, control the warning signal generator to provide a first warning signal according to the attribute and the behavior of the target object, and control the warning signal generator to provide a second warning signal according to dynamic information of the vehicle, and the attribute and the behavior of the target object.

In an embodiment of the disclosure, the processor includes a behavior prediction unit and a collision prediction unit. The behavior prediction unit determines the attribute and the behavior of the target object according to whether the sensing data meets at least one of multiple preset features and correspondingly generates a prediction result. The processor controls the warning signal generator to provide the first warning signal according to the prediction result. The collision prediction unit calculates a collision probability of the vehicle and the target object according to the prediction result and the dynamic information. The processor controls the warning signal generator to provide the second warning signal according to the collision probability.

In an embodiment of the disclosure, the sensing data includes at least one of image data, sound data, temperature data, azimuth data, and distance data.

In an embodiment of the disclosure, the dynamic information includes at least one of a position, a speed, an acceleration, and a movement direction of the vehicle.

In an embodiment of the disclosure, the processor calculates a relative coordinate position of the vehicle and the target object according to the position of the vehicle and the sensing data, predicts a movement trajectory of the vehicle according to the position, the speed, the acceleration, and the movement direction of the vehicle, and calculates a collision probability of the vehicle and the target object according to the movement trajectory, the speed, and the acceleration of the vehicle, the relative coordinate position of the vehicle and the target object, and the attribute and the behavior of the target object.

In an embodiment of the disclosure, the attribute of the target object includes at least one of a type and a size of the target object, and the behavior of the target object includes a dynamic change of the target object relative to the vehicle.

The disclosure further provides a warning method of a warning device of a vehicle, which includes the following steps. A target object is sensed to generate sensing data. An attribute and a behavior of the target object are determined according to the sensing data. A first warning signal is provided according to the attribute and the behavior of the target object. A second warning signal is provided according to dynamic information of the vehicle, and the attribute and the behavior of the target object.

In an embodiment of the disclosure, the warning method of the warning device of the vehicle includes the following steps. The attribute and the behavior of the target object are determined according to whether the sensing data meets at least one of multiple preset features and a prediction result is correspondingly generated. The first warning signal is provided according to the prediction result. A collision probability of the vehicle and the target object is calculated according to the prediction result and the dynamic information. The second warning signal is provided according to the collision probability.

In an embodiment of the disclosure, the sensing data includes at least one of image data, sound data, temperature data, azimuth data, and distance data.

In an embodiment of the disclosure, the dynamic information includes at least one of a position, a speed, an acceleration, and a movement direction of the vehicle.

In an embodiment of the disclosure, the warning method of the warning device of the vehicle includes the following steps. A relative coordinate position of the vehicle and the target object is calculated according to the position of the vehicle and the sensing data. A movement trajectory of the vehicle is predicted according to the position, the speed, the acceleration, and the movement direction of the vehicle. A collision probability of the vehicle and the target object is calculated according to the movement trajectory, the speed, and the acceleration of the vehicle, the relative coordinate position of the vehicle and the target object, and the attribute and the behavior of the target object.

In an embodiment of the disclosure, the attribute of the target object includes at least one of a type and a size of the target object, and the behavior of the target object includes a dynamic change of the target object relative to the vehicle.

Based on the above, the embodiments of the disclosure determine the attribute and the behavior of the target object according to the sensing data of the sensor, provide the first warning signal according to the attribute and the behavior of the target object, and provide the second warning signal according to the dynamic information of the vehicle, and the attribute and the behavior of the target object, so as to help the driver to grasp the surrounding environment in advance to effectively predict and prevent accidents, thereby improving driving safety.

DETAILED DESCRIPTION OF DISCLOSED EMBODIMENTS

Figure 1:
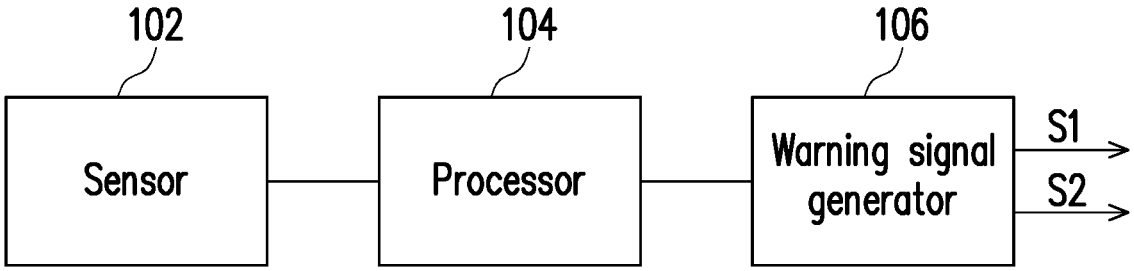
FIG. 1 is a schematic diagram of a warning device of a vehicle according to an embodiment of the disclosure.

FIG. 1 is a schematic diagram of a warning device of a vehicle according to an embodiment of the disclosure. Please refer to FIG. 1. The warning device of the vehicle includes a sensor 102, a processor 104, and a warning signal generator 106. The processor 104 is coupled to the sensor 102 and the warning signal generator 106. The vehicle may be a transportation device such as a train, an airplane, a truck, a bus, a recreational vehicle, a high-speed rail, a mass rapid transit, and a ship, but not limited thereto. The sensor 102 may sense a target object such as a train, an airplane, a high-speed rail, a mass rapid transit, a ship, a vehicle, a pedestrian, and an animal outside the vehicle, and the sensor 102 may, for example, include at least one of a camera, a microphone, a thermal imaging camera, and a distance sensor to collect image data, sound data, temperature data, azimuth data, distance data, etc., but not limited thereto. The processor 104 may be, for example, implemented by a central processing unit, but not limited thereto. The processor 104 may determine an attribute and a behavior of the target object according to sensing data generated by the sensor 102 sensing the target object.

The attribute of the target object may, for example, include a type, a size, an age, etc. of the target object. For example, the processor 104 may determine that the target object is a truck, a bus, a recreational vehicle, a motorcycle, a bicycle, an elderly, a middle-aged, a child, an animal, etc. In addition, the behavior of the target object may, for example, be a dynamic change, such as overtaking, cutting, and braking of a vehicle or a motion, etc. of a pedestrian or an animal crossing the road, of the target object. For example, in the embodiment of FIG. 2, when a vehicle 200 with a warning device is driving on a road RO1 in the direction of the arrow, there is a target object TA1 (the target object TA1 is an elderly in this embodiment) in front crossing the road in the direction of the arrow and there is another target object TA2 (the target object TA2 is a recreational vehicle in this embodiment) behind overtaking the vehicle in the direction of the arrow. In this embodiment, the sensor 102 is illustrated by taking a camera as an example. The sensor 102 may capture required image data. The processor 104 further inputs the image data generated by the sensor 102 to an artificial neural network after deep learning to identify feature information of the target objects TA1 and TA2 and determine the attributes and the behaviors of the target objects TA1 and TA2. For example, in the embodiment of FIG. 2, the crossing motion of the target object TA1 and the overtaking motion of the target object TA2 may be determined, but not limited thereto. Furthermore, the processor 104 may identify that at least one of the target objects TA1 and TA2 is an adult, a child, an animal, a truck, a bus, a recreational vehicle, a motorcycle, or a bicycle according to, for example, a facial feature, a size, a body shape feature, and a contour feature, and determine the behaviors of the target objects TA1 and TA2 according to body motions, position changes, speeds, and accelerations of the target objects TA1 and TA2.

After the processor 104 determines the attributes and the behaviors of the target objects TA1 and TA2, the processor 104 may control the warning signal generator 106 to provide a first warning signal S1 to remind the driver of the vehicle 200 to pay attention to the target objects TA1 and TA2. For example, when the processor 104 determines the attributes of the target objects TA1 and TA2, the processor 104 may control the warning signal generator 106 to provide an image signal or a sound signal to remind the driver that the target object TA1 in front detected by the sensor 102 is an elderly, and the detected target object TA2 behind is a recreational vehicle. Also, when the behaviors of the elderly (the target object TA1) and the recreational vehicle (the target object TA2) are determined, the processor 104 may control the warning signal generator 106 to provide an image signal or a sound signal to further remind the driver that the elderly (the target object TA1) is crossing the road in front of the vehicle 200, and the recreational vehicle (the target object TA2) is overtaking behind the vehicle 200, so that the driver may grasp the surrounding environment in advance to effectively predict and prevent accidents, thereby improving driving safety of the vehicle 200, such as driving safety of a train, an airplane, a truck, a bus, an recreational vehicle, a high-speed rail, a mass rapid transit, a ship, and other transportation devices.

It is worth noting that the basis for determining the attributes and the behaviors of the target objects TA1 and TA2 is only an exemplary embodiment and is not limited thereto. For example, in some embodiments, the processor 104 may determine more detailed behavior content of the target objects TA1 and TA2 according to specific feature information and dynamic changes. The more detailed behavior content, for example, includes determining the motion intention (such as crossing the road or letting the vehicle to pass first) of the pedestrian according to whether there is any hand gesture of the pedestrian (such as the target object TA1) in the sensing data or determining whether the vehicle (such as the target object TA2) has overtaking or cutting motion according to whether there is any direction light flashing in the sensing data. In other embodiments, the warning device of the vehicle may include multiple sensors 102, and the processor 104 may simultaneously determine the attributes and the behaviors of the target objects TA1 and TA2 according to sensing data of the multiple sensors. For example, in addition to determining the attributes and the behaviors of the target objects TA1 and TA2 according to image data, the processor 104 may also determine the same according to temperature data of a thermal imaging camera, sound data of a microphone, and distance data of a distance sensor.

In addition, the processor 104 may also receive the dynamic information of the vehicle 200 such as at least one of the position, the speed, the acceleration, and the movement direction of the vehicle 200 through a vehicle network. The processor 104 may control the warning signal generator 106 to provide a second warning signal S2 according to the dynamic information of the vehicle 200, and the attribute and the behavior of the target object. For example, the processor 104 may calculate a relative coordinate position of the vehicle 200 and the target object according to the position of the vehicle 200, the azimuth data of the target object, and the distance data between the target object and the vehicle 200, and predict the movement trajectory of the vehicle 200 according to the position, the speed, the acceleration, and the movement direction of the vehicle 200, thereby calculating a collision probability of the vehicle 200 and the target object according to the movement trajectory, the speed, and the acceleration of the vehicle 200, the relative coordinate position of the vehicle 200 and the target object, and the attribute and the behavior of the target object. When the collision probability is higher than a preset value, the processor 104 controls the warning signal generator 106 to provide the second warning signal S2. The second warning signal S2 may be at least one of an image signal, a vibration signal, and a sound signal to remind the driver to pay attention, such as informing the driver of the possible collision probability, but not limited thereto.

The first warning signal S1 and the second warning signal S2 may have a difference in warning level. For example, the warning effect of the second warning signal S2 may be greater than the warning effect of the first warning signal S1. For example, the first warning signal S1 may be an image signal displayed on a screen, and the second warning signal S2 may be a sound signal that is easier to attract the attention of the driver. For another example, in the case where the first warning signal S1 and the second warning signal S2 are both image signals, the second warning signal S2 may have a more vivid color (such as bright yellow) than the first warning signal S1, or in the case where the first warning signal S1 and the second warning signal S2 are both sound signals, the second warning signal S2 may have a louder volume than the first warning signal S1.

Figure 2:
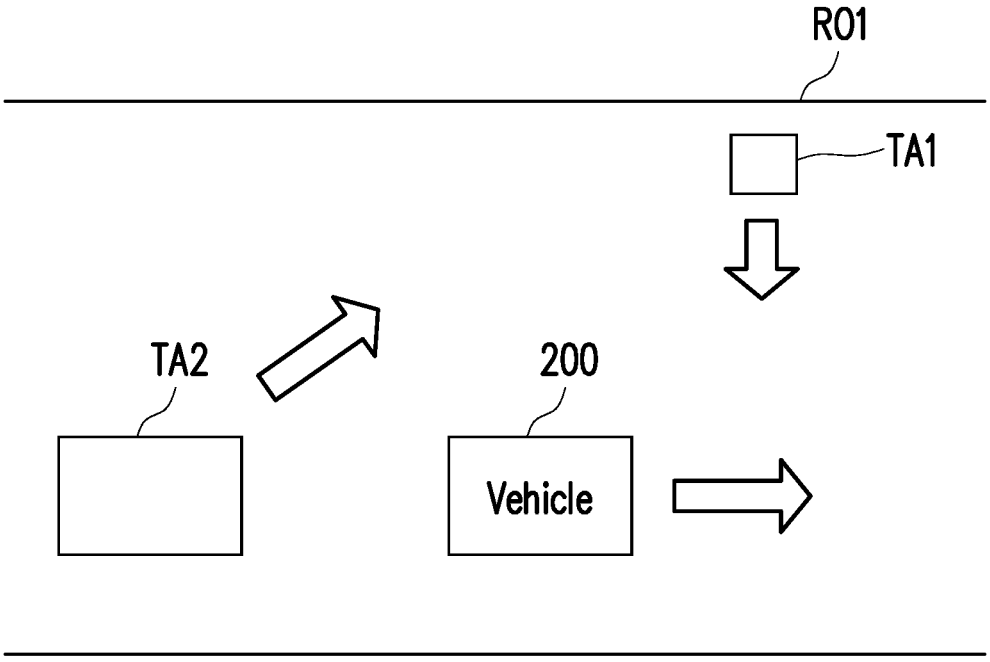
FIG. 2 is a schematic diagram of a vehicle and a target object according to an embodiment of the disclosure.

In some embodiments, the warning level of the second warning signal S2 may be adjusted, such as adjusting the color of the image signal or the volume of the sound signal, according to the magnitude of the collision probability. For example, when the speed of the vehicle 200 is faster, the collision probability of the vehicle 200 and the target object TA1 is higher. For another example, compared with the collision probability when the behavior of the target object TA1 is displayed as "letting the vehicle to pass first with a hand gesture", the collision probability when the behavior of the target object TA1 is displayed as "crossing the road" is higher. In addition, the attribute of the target object TA1 may also affect the collision probability. For example, considering that people of different ages have different reaction speeds to emergencies, the collision probability of the target object TA1 being a middle-aged is lower than the collision probability of the target object TA1 being an elderly. For another example, the processor 104 may determine the collision probability of the vehicle 200 and the target object TA2 according to the movement direction of the vehicle 200 and the behavior of the target object TA2. For example, in the embodiment of FIG. 2, when the behavior of the target object TA2 is "overtaking", the collision probability when the movement direction of the vehicle 200 maintains in the forward direction as shown in FIG. 2 is lower than the collision probability when the target object TA2 and the vehicle 200 both simultaneously intend to change from the original lane to the same lane. In addition, the attribute of the target object TA2 may also affect the collision probability. For example, considering that different types of vehicles require different distances for braking, the collision probability of the target object TA2 being a recreational vehicle is lower than the collision probability of the target object TA2 being a large truck. When the cases with high collision probability occur, the image signal may be adjusted to a more vivid color or the volume of the sound signal may be increased to increase the warning level of the second warning signal S2.

Through the above method, the attributes and the behaviors of the target objects TA1 and TA2 are determined according to the sensor 102 to provide the first warning signal S1, and the collision probability is calculated according to the dynamic information of the vehicle 200, and the attributes and the behaviors of the target objects TA1 and TA2 to provide the second warning signal S2, so as to help the driver to grasp the surrounding environment in advance to effectively predict and prevent accidents, thereby improving driving safety.

Figure 3:
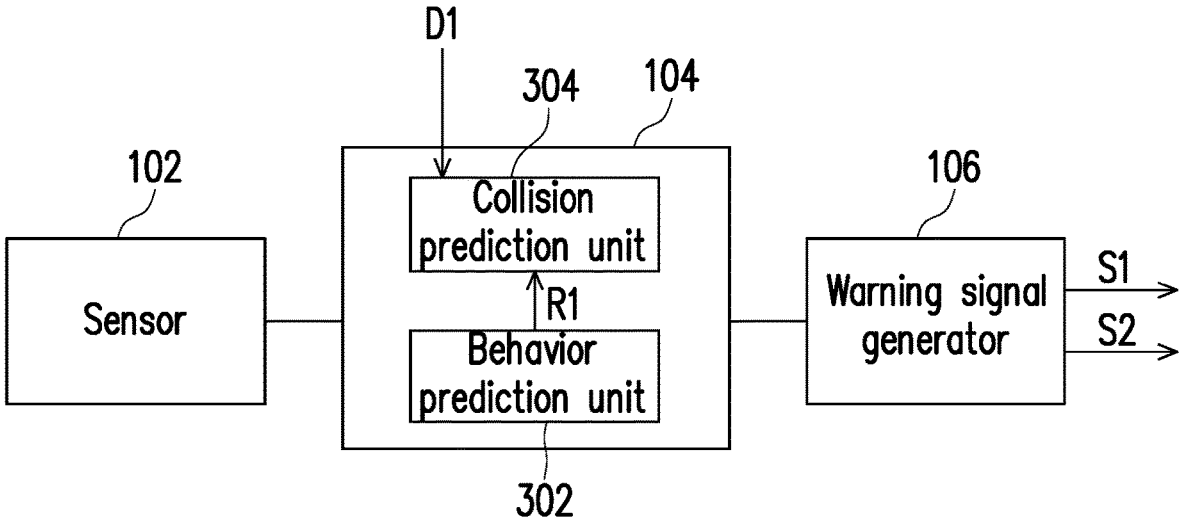
FIG. 3 is a schematic diagram of a warning device of a vehicle according to another embodiment of the disclosure.

FIG. 3 is a schematic diagram of a warning device of a vehicle according to another embodiment of the disclosure. Further, the processor 104 may include a behavior prediction unit 302 and a collision prediction unit 304. The behavior prediction unit 302 and the collision prediction unit 304 may, for example, be implemented as hardware circuits, or be implemented as software executed by the processor 104. The behavior prediction unit 302 may determine the attribute and the behavior of the target object according to whether the sensing data of the sensor 102 meets at least one of multiple preset features, and accordingly generate a prediction result R1 (that is, the determined attribute and behavior of the target object). The preset features may, for example, be the facial feature, the size, the body shape feature, the contour feature, the body motion, the position change, the speed, the acceleration, etc. The processor 104 may control the warning signal generator 106 to provide the first warning signal S1 according to the prediction result R1. In addition, the collision prediction unit 304 may calculate the collision probability of the vehicle 200 and the target object according to the prediction result R1 and dynamic information D1 of the vehicle 200 obtained through the vehicle network. The processor 104 may control the warning signal generator 106 to provide the warning signal S2 according to the collision probability. Since the way of determining the attribute and the behavior of the target object and the way of generating the first warning signal S1 and the second warning signal S2 have been described in the foregoing embodiment, there will be no reiteration here.

Figure 4:
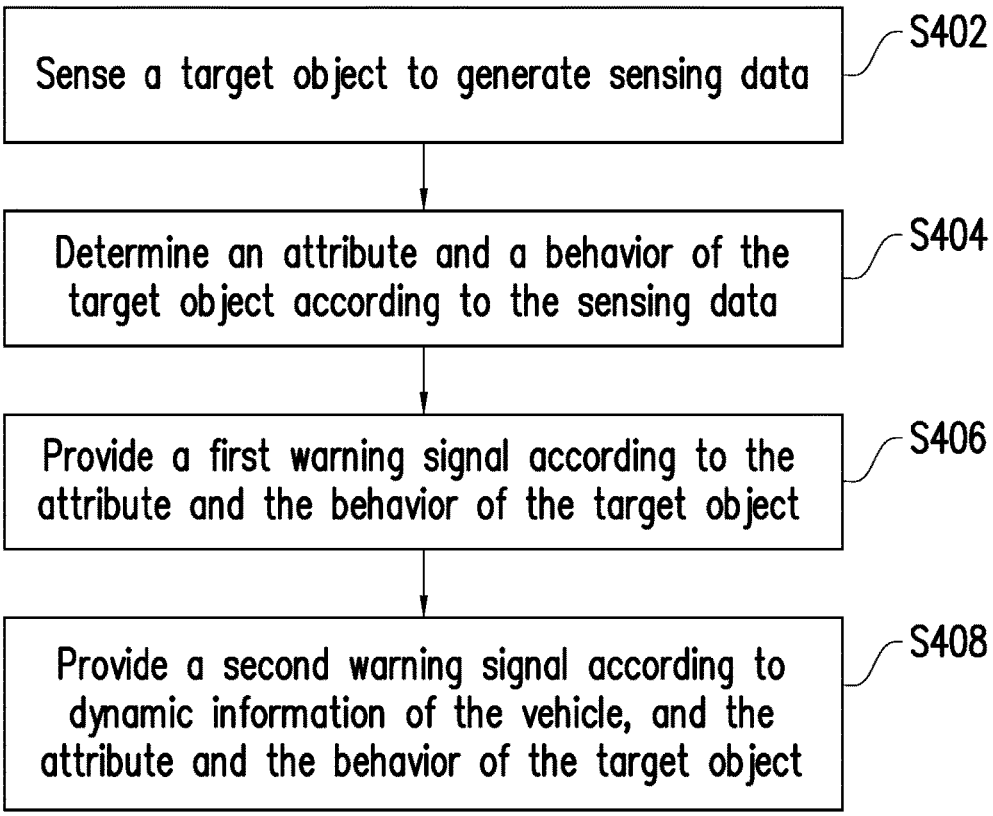
FIG. 4 is a flowchart of a warning method of a warning device of a vehicle according to an embodiment of the disclosure.

FIG. 4 is a flowchart of a warning method of a warning device of a vehicle according to an embodiment of the disclosure. It can be seen from the foregoing embodiment that the warning method of the warning device of the vehicle may at least include the following steps. Firstly, a target object is sensed to generate sensing data (Step S402). The sensing data may include at least one of image data, sound data, temperature data, azimuth data, and distance data, but not limited thereto. Then, an attribute and a behavior of the target object are determined according to the sensing data (Step S404). For example, the attribute and the behavior of the target object may be determined according to whether the sensing data meets at least one of multiple preset features, and a prediction result is correspondingly generated. The attribute of the target object may, for example, be a type, a size, an age, etc. of the target object, the behavior of the target object may, for example, be a dynamic change of the target object, and the preset features may, for example, be a facial feature, a size, a body shape feature, a contour feature, a body motion, a position change, a speed, an acceleration, etc., but not limited thereto. Then, a first warning signal is provided according to the attribute and the behavior of the target object (Step S406), that is, the first warning signal may be provided according to the prediction result. After that, a second warning signal may be provided according to dynamic information of the vehicle, and the attribute and the behavior of the target object (Step S408). For example, a collision probability of the vehicle and the target object may be calculated according to the dynamic information of the vehicle and the prediction result, and the second warning signal may be provided according to the collision probability. The dynamic information may, for example, include at least one of a position, a speed, an acceleration, and a movement direction of the vehicle. The first warning signal and the second warning signal may, for example, include at least one of an image signal or a sound signal. Furthermore, the way of calculating the collision probability may be, for example, calculating a relative coordinate position of the vehicle and the target object according to the position of the vehicle and the sensing data, predicting a movement trajectory of the vehicle according to the position, the speed, the acceleration, and the movement direction of the vehicle, and calculating the collision probability of the vehicle and the target object according to the movement trajectory, the speed, and the acceleration of the vehicle, the relative coordinate position of the vehicle and the target object, and the attribute and the behavior of the target object.

In summary, the embodiments of the disclosure determine the attribute and the behavior of the target object according to the sensing data of the sensor, provide the first warning signal according to the attribute and the behavior of the target object, and provide the second warning signal according to the dynamic information of the vehicle, and the attribute and the behavior of the target object, so as to help the driver to grasp the surrounding environment in advance to effectively predict and prevent accidents, thereby improving driving safety.

What is claimed is:

1. A warning device of a vehicle, comprising:

a warning signal generator;

a sensor, configured to sense a target object to generate sensing data; and a processor, coupled to the warning signal generator and the sensor, and configured to:

determine an attribute of the target object according to whether the sensing data meets at least one of a plurality of first preset features;

determine a behavior of the target object according to whether the sensing data meets at least one of a plurality of second preset features; and control the warning signal generator to provide a first warning signal according to the attribute and the behavior of the target object, and control the warning signal generator to provide a second warning signal according to dynamic information of the vehicle, and the attribute and the behavior of the target object, wherein the plurality of first preset features comprises a facial feature, a size, a body shape feature, and a contour feature, and the plurality of second preset features comprises body motions, position changes, speeds, and accelerations of the target objects, wherein the warning effect of the second warning signal is greater than the warning effect of the first warning signal.

2. The warning device of the vehicle according to claim 1, wherein the processor comprises:

a behavior prediction unit, configured to determine the attribute and the behavior of the target object and correspondingly generate a prediction result, wherein the processor controls the warning signal generator to provide the first warning signal according to the prediction result; and a collision prediction unit, configured to calculate a collision probability of the vehicle and the target object according to the prediction result and the dynamic information, wherein the processor controls the warning signal generator to provide the second warning signal according to the collision probability.

3. The warning device of the vehicle according to claim 1, wherein the sensing data comprises at least one of image data, sound data, temperature data, azimuth data, and distance data.

4. The warning device of the vehicle according to claim 1, wherein the dynamic information comprises at least one of a position, a speed, an acceleration, and a movement direction of the vehicle.

5. The warning device of the vehicle according to claim 4, wherein the processor calculates a relative coordinate position of the vehicle and the target object according to the position of the vehicle and the sensing data, predicts a movement trajectory of the vehicle according to the position, the speed, the acceleration, and the movement direction of the vehicle, and calculates a collision probability of the vehicle and the target object according to the movement trajectory, the speed, and the acceleration of the vehicle, the relative coordinate position of the vehicle and the target object, and the attribute and the behavior of the target object.

6. The warning device of the vehicle according to claim 1, wherein the attribute of the target object comprises at least one of a type and a size of the target object, and the behavior of the target object comprises a dynamic change of the target object relative to the vehicle.

7. A warning method of a warning device of a vehicle, comprising:

sensing a target object to generate sensing data;

determining an attribute of the target object according to whether the sensing data meets at least one of a plurality of first preset features;

determining a behavior of the target object according to whether the sensing data meets at least one of a plurality of second preset features;

providing a first warning signal according to the attribute and the behavior of the target object; and providing a second warning signal according to dynamic information of the vehicle, and the attribute and the behavior of the target object, wherein the plurality of first preset features comprises a facial feature, a size, a body shape feature, and a contour feature, and the plurality of second preset features comprises body motions, position changes, speeds, and accelerations of the target objects, wherein the warning effect of the second warning signal is greater than the warning effect of the first warning signal.

8. The warning method of the warning device of the vehicle according to claim 7, comprising:

determining the attribute and the behavior of the target object and correspondingly generating a prediction result;

providing the first warning signal according to the prediction result;

calculating a collision probability of the vehicle and the target object according to the prediction result and the dynamic information; and providing the second warning signal according to the collision probability.

9. The warning method of the warning device of the vehicle according to claim 7, wherein the sensing data comprises at least one of image data, sound data, temperature data, azimuth data, and distance data.

10. The warning method of the warning device of the vehicle according to claim 7, wherein the dynamic information comprises at least one of a position, a speed, an acceleration, and a movement direction of the vehicle.

11. The warning method of the warning device of the vehicle according to claim 10, comprising:

calculating a relative coordinate position of the vehicle and the target object according to the position of the vehicle and the sensing data;

predicting a movement trajectory of the vehicle according to the position, the speed, the acceleration, and the movement direction of the vehicle; and calculating a collision probability of the vehicle and the target object according to the movement trajectory, the speed, and the acceleration of the vehicle, the relative coordinate position of the vehicle and the target object, and the attribute and the behavior of the target object.

12. The warning method of the warning device of the vehicle according to claim 7, wherein the attribute of the target object comprises at least one of a type and a size of the target object, and the behavior of the target object comprises a dynamic change of the target object relative to the vehicle.

* * * * *